US006615454B1

(12) United States Patent
Anthony

(10) Patent No.: US 6,615,454 B1
(45) Date of Patent: Sep. 9, 2003

(54) ENHANCED SEPARATION OF CONTAMINANTS FROM FIBERS SUCH AS COTTON, KENAF AND FLAX

(75) Inventor: William S. Anthony, Greenville, MS (US)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 0 days.

(21) Appl. No.: 10/247,156

(22) Filed: Sep. 19, 2002

(51) Int. Cl.[7] ..... D01B 1/04
(52) U.S. Cl. ..... 19/41; 19/48 R; 19/200
(58) Field of Search ..... 19/39, 40, 41, 19/44, 482, 50, 54, 55 R, 58, 59, 61, 62 R, 55 A, 64.5, 107, 108, 113, 51, 200; 241/242

(56) References Cited

U.S. PATENT DOCUMENTS 4,214,348 A * 7/1980 Schwartz et al. ..... 19/203
4,399,591 A * 8/1983 Schwartz et al. ..... 19/202
4,654,933 A * 4/1987 Horn et al. ..... 19/200
4,984,334 A * 1/1991 Wilkes et al. ..... 19/48 R
5,295,283 A * 3/1994 Gillum et al. ..... 19/55 R
5,392,495 A * 2/1995 Horn ..... 19/55 R
5,442,835 A * 8/1995 Walker et al. ..... 19/95
5,697,126 A * 12/1997 Baker, Jr. ..... 19/41
5,909,786 A 6/1999 Anthony
6,159,094 A * 12/2000 Deutsch ..... 460/98
6,421,991 B1 * 7/2002 Goering et al. ..... 56/28

OTHER PUBLICATIONS

W.S. Anthony et al., Cotton Ginners Handbook, U.S. Department of Agriculture, Agricultural Research Service, Agricultural Handbook No. 503, Dec. 1994.

* cited by examiner

*Primary Examiner*—Gary L. Welch
(74) *Attorney, Agent, or Firm*—John D. Fado; Joseph A. Lipovsky

(57) ABSTRACT

In the cleaning of cotton, flax and kenaf and related materials in the ginning process there is typically a loss of cotton in the saw type lint cleaner. Amounts lost here are typically in the range of about 20 pounds per 500 pound bale. The present invention is directed to the inclusion of an additional saw cylinder in the saw type lint cleaner for the purpose of separating the cotton out of the rejected fiber from the passage through the first saw tooth lint cleaner. The additional saw is doffed by the same brush cleaner that doffs the primary saw cylinder.

6 Claims, 5 Drawing Sheets

ENHANCED SEPARATION OF CONTAMINANTS FROM FIBERS SUCH AS COTTON, KENAF AND FLAX

BACKGROUND OF THE INVENTION

1. Field of the Invention

The present invention relates to enhanced extraction and cleaning of fibrous materials like cotton, kenaf and flax. More specifically, the present invention provides an apparatus and a method for reducing cotton waste by lint cleaners.

2. Description of the Prior Art

Over 80 million bales of cotton are produced annually in the world. These cottons are harvested by hand or mechanically by machines called spindle-harvesters or cotton strippers. Depending upon the harvesting method, these cottons are precleaned through various machines in a cotton-gin processing plant and are dried prior to the fiber being separated from the seed. After the fiber is separated from the seed, it is further cleaned by different types of machines that are typically called lint cleaners. Lint cleaners were developed specifically for removing leaf particles, motes, grass and bark that remain in cotton after seed cleaning, extracting and ginning. They were developed and improved in conjunction with the transition from manual to mechanical harvesting of cotton in the United States during the 1950's. Virtually all gins in the United States have lint cleaning facilities, and over four-fifths of the gins have two or more stages of lint cleaning.

A thorough description of the cotton ginning process and the various components utilized is described by Anthony, W. S., et al. (Editors), *Cotton Ginner's Handbook*, Agricultural Handbook No. 503, USDA: Agricultural Research Service, December 1994, the contents of which are incorporated by reference herein.

From the gin stand, the cotton is conveyed to a lint cleaner for the further removal of foreign matter such as trash, plant parts, leaf particles, motes, grass and bark that may remain in cotton after cleaning, extracting and ginning. The most common lint cleaner in the ginning industry is the controlled-batt saw lint cleaner (SLC), although some SLC's function without the controlled-bat feature (the controlled-batt feature is not necessary for the invention to work). In the SLC, lint from the gin stand is formed into a batt on a condenser screen drum. The batt is then fed through one or more sets of compression rollers and between a feed roller and a feed plate to deliver a batt of uniform thickness onto a saw cylinder. The saw carries fibers under grid bars. While fibers are on the saw cylinder, they are cleaned of foreign matter by a combination of centrifugal force, scrubbing action between saw cylinder and grid bars, and gravity assisted by an air current. After the cotton has passed through the lint cleaner, the cleaned cotton is compressed into bales which must then be covered to protect them from contamination during transportation or storage.

Although the saw lint cleaner is the most effective cleaning machine in the gin, it is also the most damaging to the fibers. Significant damage to the fibers may occur as they are transferred from the condenser and rollers onto the saw cylinder, and as the fibers are cleaned while on the saw. The saw cylinder rotates at a high speed and in the controlled-batt SLC, in a direction which is opposite to the flow of cotton from the roller and feed plate. The abrupt change in speed and direction of the flow of the cotton batt as it is engaged by the saw cylinder creates a combing action, which aligns the fibers and gives them a smoother appearance. However, this also subjects the fibers to a high degree of stress, resulting in fiber breakage. Additional fiber loss and fiber damage occurs as the fibers are carried by the saw cylinder across succession grid bars in all types of SLC's.

The most common lint cleaner in the ginning industry is called the saw-type lint cleaner which removes 15 to 30 pounds of material per bale, with much of this being useable fiber. In terms of principals of operation, a thin batt of cotton fiber is fed mechanically into a cylinder wound with fine-tooth saws. The saw grasps the cotton fiber and pulls it between the saw cylinder and a set of closely spaced (0.06 to 0.12 inches) cleaning points commonly called grid bars. Saw-type lint cleaners typically have 5 to 9 grid bars each. Each grid bar location creates a cleaning point that separates and ejects cotton fiber and foreign matter from the saw tooth-engaged cotton. The first grid bar separates and ejects a high percentage of foreign matter and a low percentage of cotton fiber. The percentage of foreign matter separated and ejected decreases dramatically and the percentage of cotton fiber separated and ejected increases dramatically as the number of grid bars increase. For example in a 5-grid bar machine, about 25, 23, 22, 15, and 15% by weight of foreign material is separated and ejected by the first, second, third, forth and fifth grid bars respectively. Therefore, as the saw toothed-engaged cotton fiber progresses successively against and under grid bars, decreasing amounts of foreign fiber and increasing amounts of cotton fiber are removed concomitant with an increase in damage to the saw toothed-engaged cotton. Furthermore, cotton fiber is separated from the saw toothed-engaged cotton and ejected, even if no foreign matter is present. Thus, the cost in lost or damaged fiber is substantial.

U.S. Pat. No. 5,909,786 (Anthony) teaches alternate technology for the reduction of fiber waste by lint cleaners by use of shroud members that may be placed on the grids bars of a saw to render individual grid bars inactive. U.S. Pat. No. 5,909,786 teaches the incorporation of shrouds that may be placed in conjunction with individual grid bars to, in essence, inactivate them.

The referenced patent application 09/962,568 hereby incorporated by reference discloses, as part of a larger system to separate contaminants from cotton and flax, an embodiment that utilizes two saw cylinders operating in tandem off of the same doffing brush.

While numerous systems for the cleaning of cotton fibers have been developed, there is clearly a need for an apparatus and method for reducing loss and waste of fiber as it is being processed through a lint cleaner. There is also a need for an enhanced cleaning and separation procol for fibers from other sources, such as kenaf and flax.

Two general types of flax (*Linum usitatissimum L.*) are grown, one for production of flax fiber and the other for flax seed. The fiber is extracted from fiber flax stalks, and is typically used in the manufacture of linen apparel. The stalk consists of fiber bundles located between the bark surface and an inner wood core (shive), and processes for the separation of the fibers are difficult and expensive. The processes for the separation of fiber from fiber flax normally require that the flax be biologically degraded or retted prior to fiber recovery. In contrast to fiber flax, the seed flax remaining after the seed is harvested is usually considered a waste product. Although the flax in the seed flax stalk is capable of being separated, it is presently considered a waste product because the processes used to separate fiber flax are not feasible with seed flax stalks.

Kenaf (*Hibiscus cannabinus L.*) is a relative to cotton and okra and grows from eight to twenty feet in height. It represents a good source of fiber and may be utilized in many industries for the production of pulp, paper and paperboard products. Its value in the production of paper is well recognized. The potential economic returns from growth of kenaf are expected to be comparable to that achieved from white corn, milo, and Upland cotton.

Thus, despite the improvements in ginning technology, the need persists for an improved ginning system which will effectively clean cotton while reducing fiber loss. Moreover, there is a need for an improved system for recovering other fiber such as kenaf and flax fiber from straw.

Examples in the instant application are drawn to cotton for which the bulk of the natural plant fiber market exits, but the invention will work with other crops for the purpose of fiber separation.

SUMMARY OF THE INVENTION

The present invention accomplishes its desired objects by broadly providing an apparatus (e.g., a saw lint cleaner) for cleaning the fiber. The apparatus includes a frame, two cylinder members (e.g., saw cylinders) rotatably supported by the frame having a cylindrical surface supporting a fiber-engaging structure (e.g., toothed wire or saw teeth), a doffing brush cylinder and a motor coupled to the cylinder member. A grid bar assembly is connected to the frame for assisting in the removal of undesirable particulates from the fiber engaged to the fiber-engaging structure of the cylinder member. The grid assembly comprises a plurality of grid bars connected to the frame in a spatial relationship such that any two grid bars are separated by a grid space. The saw cylinders are so arranged so that they are doffed by the same brush cylinder.

The result of this arrangement is that the material removed by the first saw cylinder which comprises a major proportion of fiber is then put through a second saw cylinder that then recovers the majority of fiber lost in the first saw cylinder. The fiber recovered by the second saw cylinder is then doffed by the same brush that doffs the first saw cylinder. The present invention also accomplishes its desired objects by further broadly providing a method of controlling and/or reducing the loss of fiber during lint cleaning of contaminated cotton.

The method comprises the steps of: providing a lint cleaner that possesses two saw cleaners operating in tandem with the same brush cylinder, such that the waste material removed by the first saw cleaner is then conveyed to the second saw cleaner, which then reseparates the waste and pulls off fiber which is then doffed by the brush cylinder.

It is therefore an object of the present invention to provide an apparatus for fiber cleaning, such as cotton, flax and kenaf.

It is another object of the present invention to provide a method for controlling and/or reducing the loss of fiber during the lint cleaning of contaminated fiber.

These, together with the various ancillary objects and features which will become apparent to those of skill in the art as the following description proceeds, are attained by these novel apparatuses and methods, a preferred embodiment thereof shown with reference to the accompanying drawings, by way of example only, wherein:

DETAILED DESCRIPTION OF THE INVENTION

Figure 1:
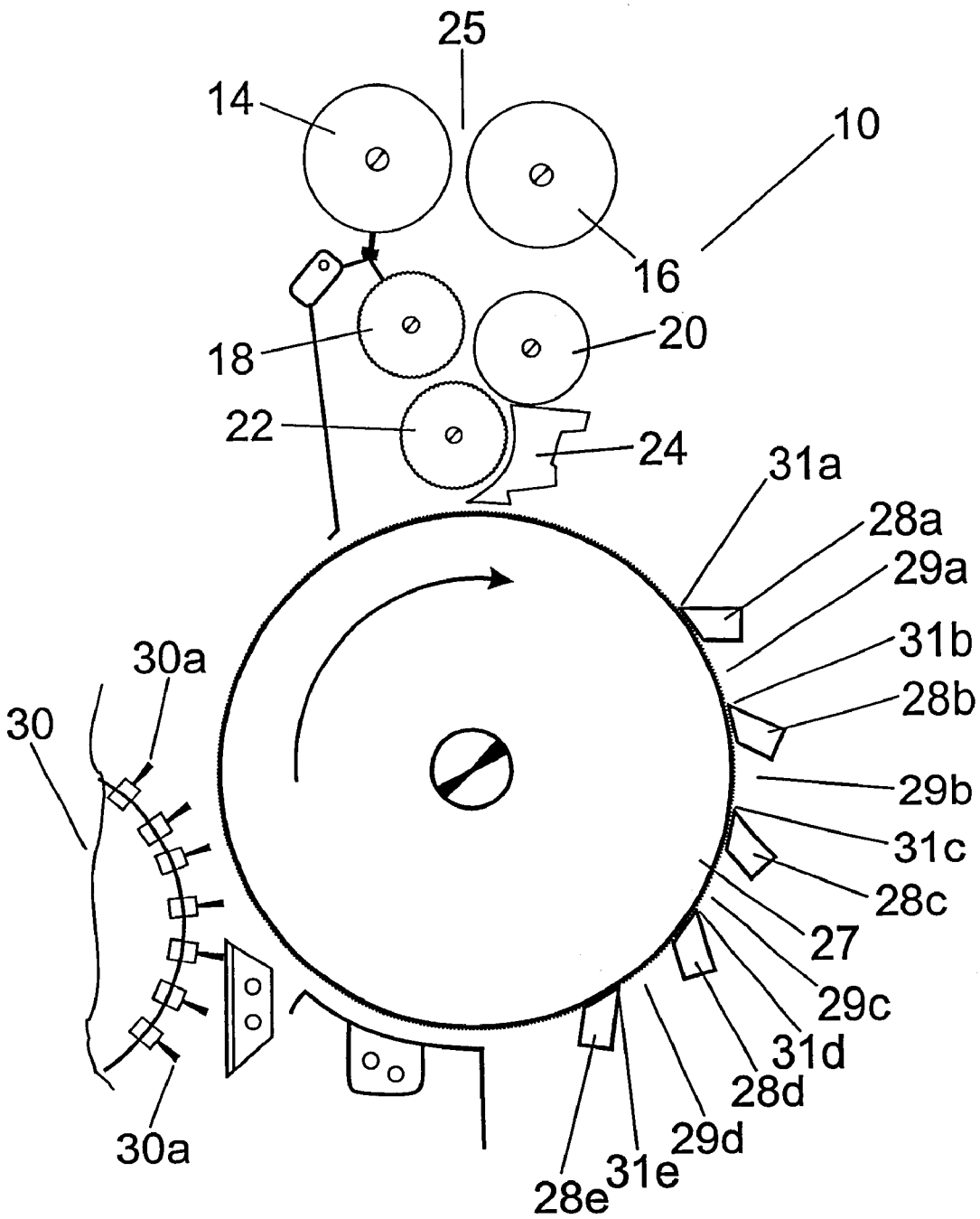
Fig. 1 PRIOR ART
FIG. 1 is a schematic end elevational view of a prior art saw lint cleaner as described in U.S. Pat. No. 5,909,786.

Referring in detail now to the drawings wherein similar parts of the inventions are identified by like reference numerals, there is seen in FIGS. 1–4 a prior art lint cleaner, generally illustrated as 10 in FIG. 1. Immediately prior to the lint cleaner 10 an apparatus typical of the industry comprises compression rollers 14, 16, 18 and 20, a feed roller 22, and a feed plate 24, all for feeding fibers of lint fiber such as cotton 25 into a first saw cylinder 26. Feed plate 24 is formed with a toe 24*a*. Lint cleaner 10 also includes a grid assembly for assisting in cleaning the lint fiber 25. Grid assembly includes a plurality of grid bars 28*a*, 28*b*, 28*c*, 28*d* and 28*e* having respective edges 31*a*, 31*b*, 31*c*, 31*d* and 31*e*, and separated by grid spaces, generally illustrated as 29. Grid bars 28*a* and 28*b*, 28*b* and 28*c*, 28*c* and 28*d*, and 28*d* and 28*e* are respectively separated by grid spaces 29*a*, 29*b*, 29*c*, and 29*d*. Doffing brush cylinder 30 has a plurality of bristles 30*a* which touch points of the saw cylinder 26 (see FIG. 1) for engaging and removing lint fiber 25 after it has been cleaned.

Although a conventional doffing brush may be used, including those with brush sticks, use of a solid face brush such as a spiral wound doffing brush is preferred to significantly reduce noise levels (see Anthony, W. S., et al., Editors, *Cotton Ginner's Handbook*, ibid, pp. 98–99, 104–105, and 284–285, the contents of which are incorporated by reference herein). The tip speed of the doffing brush cylinder must be greater than the tip speed of the projections (saw teeth) 27 on either the first saw cylinder 26 or the second saw cylinder 36, described further below, in order to be effective for the removal of fiber therefrom. Preferable doffing brush tip speeds are approximately 1.5 to 2 times the tip speed of the saw cylinders. Both the doffing brush 30 and saw cylinders 26 and 36 are driven by one or more motors, preferably variable speed motors (not shown).

Saw cylinder 26 is covered with toothed wire (or saw teeth) 27 wound in a spiral from one end to the other end of the saw cylinder 26. Typically, there are eight spiral wraps of wire per inch of saw cylinder length. There are normally 5–6 teeth/linear inch of wire, creating a cylinder population of about 45 teeth/sq. in. Toothed wire 27 is needle sharp to properly comb fibers such as cotton from the batt.

Lint cleaners, such as lint cleaner 10, were developed specifically for removing leaf particles, immature seeds, motes, grass, and bark, collectively designated herein as foreign matter 7, that remains in lint cotton 25 after seed cotton cleaning, extracting, and ginning. In order to separate foreign matter 7 from lint cotton 25, lint cotton 25 of the controlled-batt saw lint cleaner is initially formed into a batt on a condenser screen drum (not seen). The batt should be of uniform thickness and be evenly spread over the entire width of the lint cleaner 10; otherwise, poor cleaning and excessive fiber loss will result. After the batt is formed, it is then initially fed through compression rollers 14, 16, 18 and 20 (driven by motors, preferably variable speed motors, not shown). The cotton is subsequently passed between the very closely fitted feed roller 22-(driven by a motor, preferably a variable speed motor, not shown) and feed plate 24 and fed onto the saw cylinder 26. Stated alternatively and more specifically, after the batt of lint cotton 25 passes through the narrow gap between the feed roller 22 and the feed plate 24, it then reverses direction around the toe 24*a* of the feed plate 24 to move onto the toothed wire 27 of the saw cylinder 26. The feed plate 24 generally clears the toothed wire 27 by about one-sixteenth inch. The feed roller 22 is preferably fluted and under spring tension, exerting pressure toward the feed plate 24 and holding the batt of lint cotton 25 while it is combed and fed onto the toothed wire 27 of saw cylinder 26.

After the lint cotton 25 has been engaged by the toothed wire 27, it is carried against and under the grid bars 28*a*, 28*b*, 28*c*, 28*d* and 28*e* of the grid assembly for removing foreign matter 7. The spacing between the grid bars 28*a*, 28*b*, 28*c*, 28*d* and 28*e* and the toothed wire of the saw blade is typically about 1/16 of an inch. The leading edges 31*a*, 31*b*, 31*c*, 31*d* and 31*e* function as cleaning edges or points and are preferably sharp to avoid reducing cleaning efficiency and increasing the loss of lint cotton, which is designated herein as loss lint cotton 25*a* after being separated from lint cotton 25. Thus, each of the leading edges 31*a*, 31*b*, 31*c*, 31*d* and 31*e* contacts the lint cotton 25 and separates or breaks free foreign matter 7, as well as loss lint cotton 25*a*, from lint cotton 25. It is to be understood that while the lint cotton 25 is engaged to the toothed wire 27 on the saw cylinder 26, it is cleaned not only by scrubbing action between the saw cylinder 26 and the grid bars (i.e. grid bars 28*a*, 28*b*, etc.) of the grid assembly 28, but also by centrifugal force and gravity which is assisted by air currents.

Figure 2:
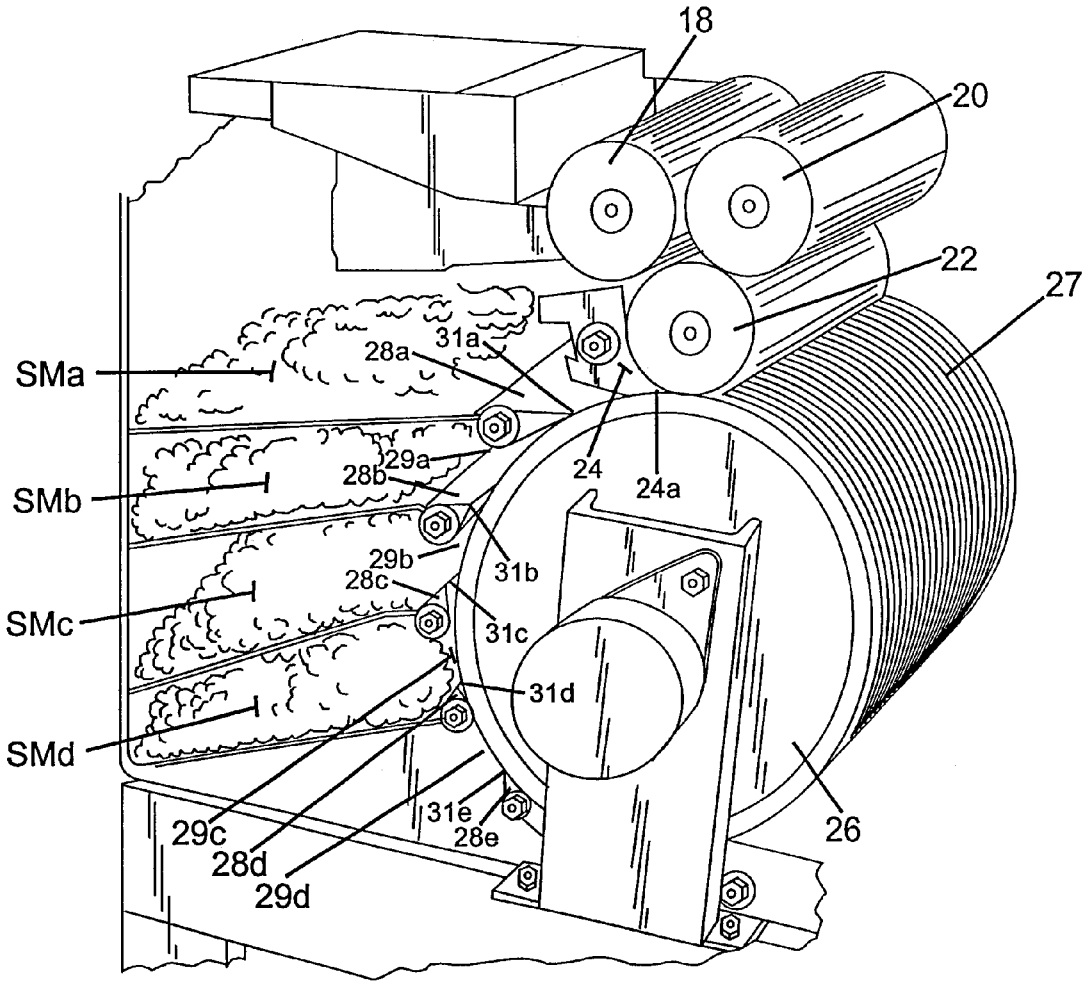
FIG. 2 PRIOR ART
FIG. 2 is a perspective view of a prior art saw cylinder after having separated foreign material and cotton fibers as described in U.S. Pat. No. 5,909,786.
Figure 3:
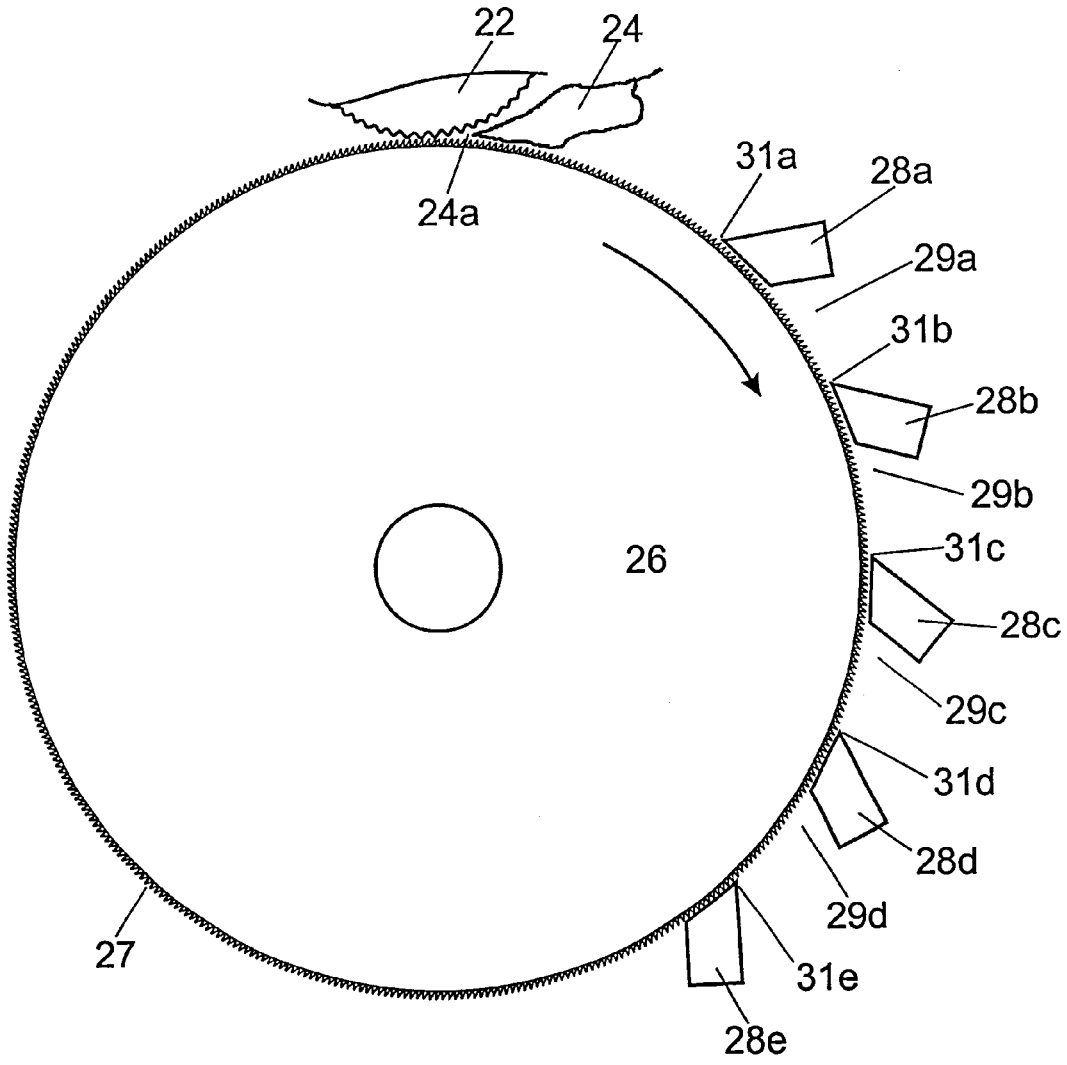
FIG. 3 PRIOR ART
FIG. 3 is an end elevational view of the saw cylinder in FIG. 1 illustrating the position of grid bars with respect to the saw cylinder as described in U.S. Pat. No. 5,909,786.
Figure 4:
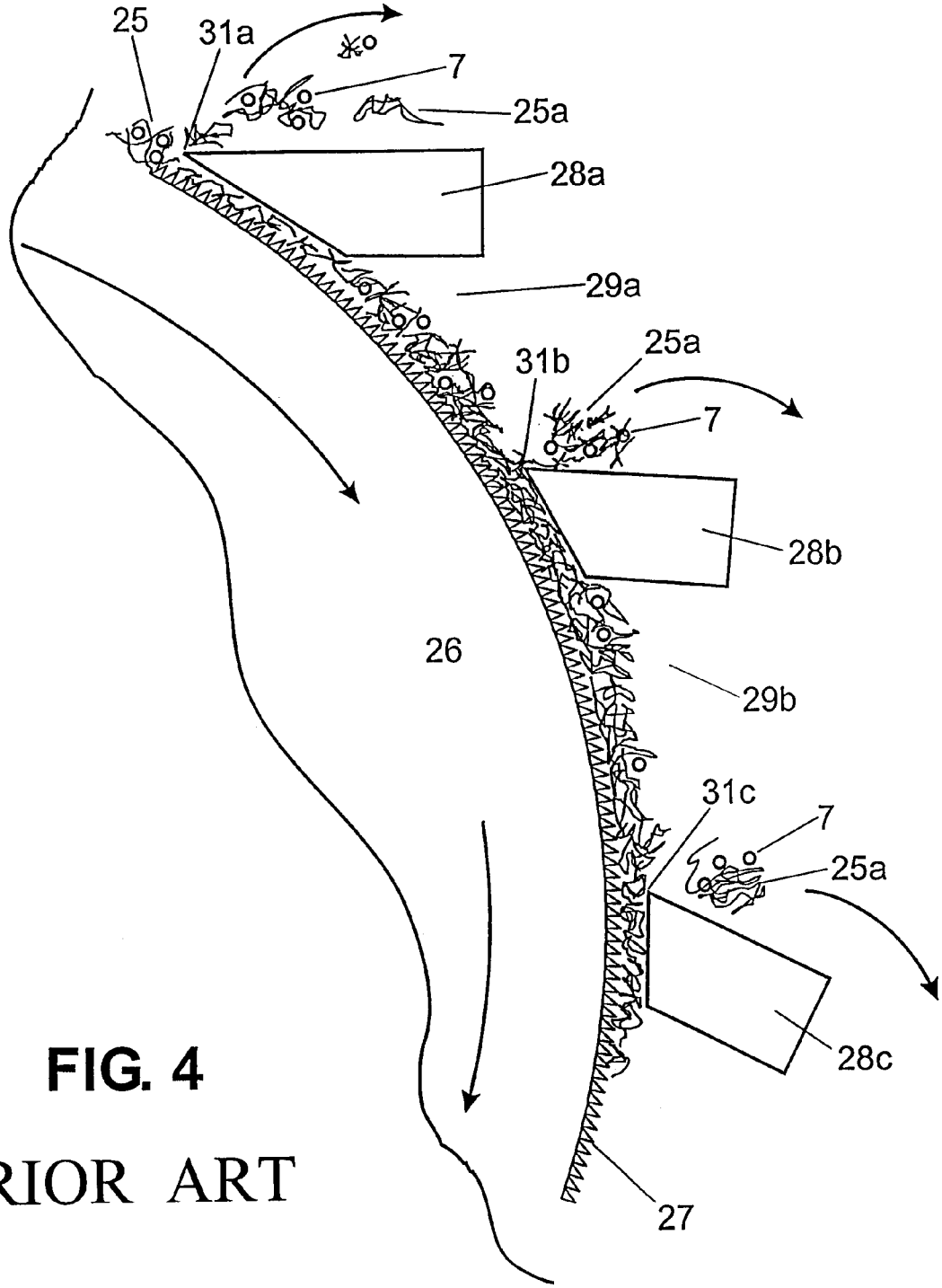
FIG. 4 PRIOR ART
FIG. 4 is a partial enlarged view and elevational view of a rotating saw cylinder having contaminated cotton engaged to its associated saw teeth and rotating past a plurality of grid bars such that the respective cleaning edges of the grid bars contact the engaged contaminated fiber, causing undesirable particulates and fiber to be separated therefrom as described in U.S. Pat. No. 5,909,786.

Leading edge 31*a* of grid bar 28*a* contacts and separates from the lint cotton 25 a high percentage of foreign matter 7 and a low percentage of loss lint cotton 25*a*. As the lint cotton 25 is continually revolved by the saw cylinder 26, it successively contacts the respective leading edges 31*b*, 31*c*, 31*d* and 31*e* of grid bars 28*b*, 28*c*, 28*d* and 28*e*, causing the percentage of foreign matter 7 separated and ejected to decrease, and the percentage of loss lint cotton 25*a* separated and ejected to increase, as the lint cotton 25 processes successively against and under respective grid bars 28*b*, 28*c*, 28*d* and 28*e*. Thus, the mixture of foreign matter 7 and loss lint cotton 25*a* passing through grid space 29*a* generally contains a higher percentage of foreign matter 7 and a lower percentage of loss lint cotton 25*a* than the mixture of foreign matter 7 and loss lint cotton 25*a* passing through grid space 29*b*. Stated alternatively, there is a higher percentage of loss lint cotton 25*a* and a lower percentage of foreign matter 7 passing through grid space 29*b* than through grid space 29*a*. By way of illustration only, there is seen in FIG. 2 separated materials SMa, SMb, SMc and SMd which were produced from the lint cotton 25 contacting the respective leading edges 31*a*, 31*b*, 31*c*, and 31*d* of the grid bars 28*a*, 28*b*, 28*c* and 28*d*. The percentage of loss lint cotton 25*a* in respective separated materials SMa, SMb, SMc and SMd increases from separated material SMa to separated material SMb, from separated material SMb to separated material SMc, and from separated material SMc to separated material SMd. The percentage of foreign matter 7 would decrease from separated material SMa to separated material SMb, from separated material SMb to separated material SMc, and from separated material SMc to separated material SMd.

Depending on the initial cleanliness of lint cotton 25, by the time lint cotton 25 contacts leading edge 31*e* of grid bar 28*e*, the matter to be separated from the lint cotton 25 could be essentially all loss lint cotton 25*a* with minimal, if any, foreign matter 7 remaining and/or available for separation and ejection. Thus, the lint cleaner 10 would over clean the lint cotton 25, resulting in an unnecessary loss of cotton fibers and possibly fiber damage to the remaining lint cotton 25, which subsequently would be removed from the toothed wire 27 of the saw cylinder 26 by the bristles 30*a* of the doffing brush cylinder 30. In order to minimize the loss of lint cotton from the separated material streams SMa, SMb, SMc and SMd, applicant has created a cleaning saw configuration (FIG. 5) utilizing the inclusion an additional saw cylinder 36 in the saw type lint cleaner for the purpose of separating the cotton out of the separated material streams SMa, SMb, SMc and SMd from the passage through the first saw tooth lint cleaner. The additional saw is doffed by the same brush cleaner 30 that doffs the primary saw cylinder.

Figure 5:
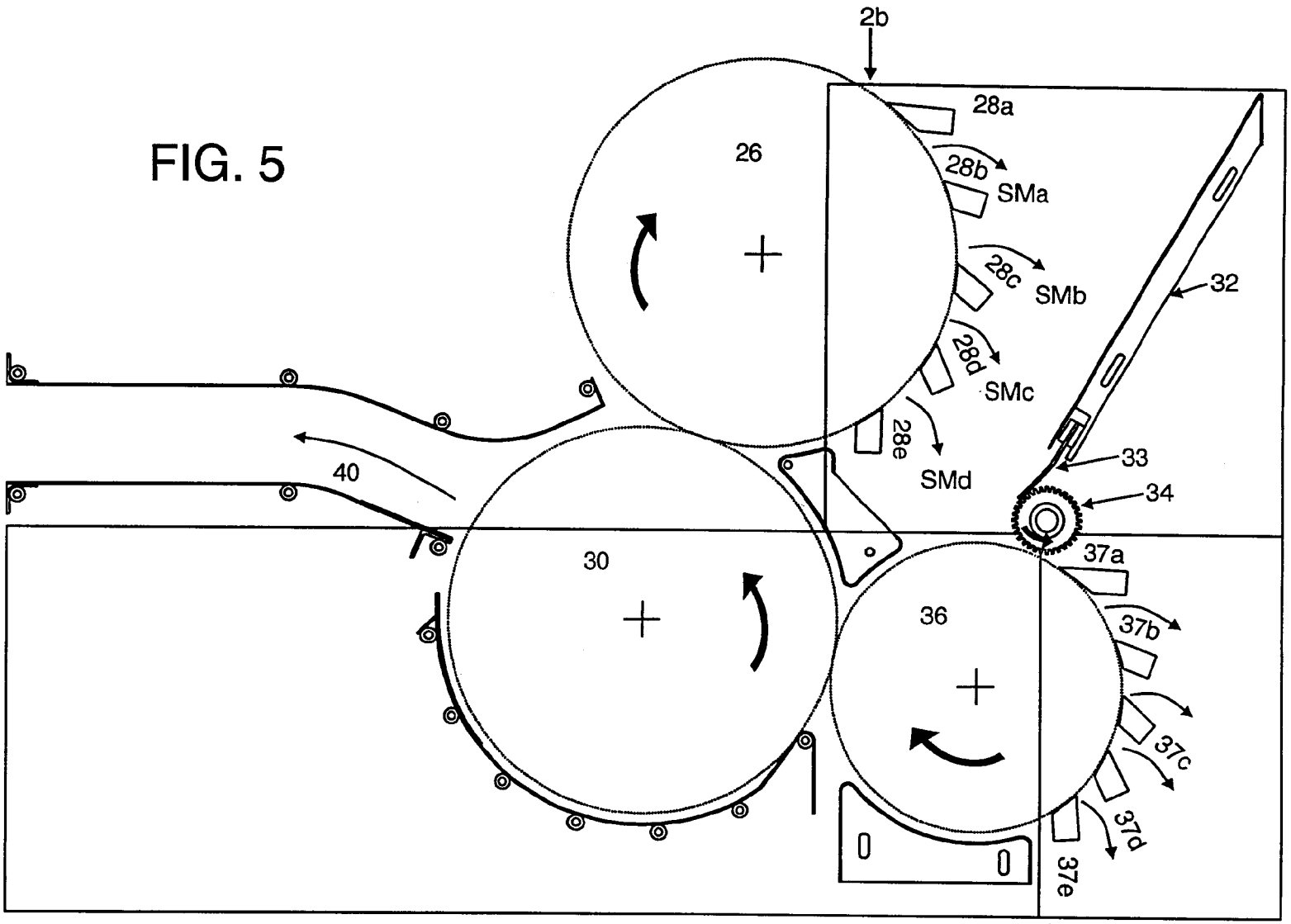
FIG. 5 is a cross sectional view of the present invention showing the utilization of two cleaning saws, wherein the waste from the first saw is separated again by the second saw, operating off the same doffing brush.

Referring in detail to FIGS. 2 and 5, fibers of lint cotton 25 are supplied from a feed plate 24 and a vertical toe of said feed plate 24*a* (shown in FIG. 2) to the cleaning saw 26 which then separates it is carried against and under the grid bars 28*a*, 28*b*, 28*c*, 28*d* and 28*e* of the grid assembly 28 for removing foreign matter. The retained cotton is removed by doffing brush 30. The separated material SMa, SMb, SMc and SMd is then dispensed as fiber/trash. This fiber/trash is captured by trash slide 32 which allows it to slide by gravity over seal 33 down to second cleaning saw 36 to which it is fed by a steel roller 34, this roller may be in the form of a steel brush or a fluted roller 34. The purpose of the brush or roller 34 is to embed the fiber/trash from the first saw into the saw blade of the second saw, and to control the depth of the accumulation and regulate its transfer to saw 36. The material is processed through grid bars 37*a*, 37*b*, 37*c*, 37*d* and 37*e* in the same way as described for grid bars 28*a*–28*e* illustrated in FIGS. 1 and 2. The lint material that remains on the cleaning saw 36 is then collected by doffing brush 30 and ultimately removed through lint duct 40. The trash and fiber ejected as waste from grid bars 37*a*, 37*b*, 37*c*, 37*d* and 37*e* are discarded as waste from the process.

An alternate embodiment of the present invention sets the spacing on the first cleaning saw of grid bar 28*a* at about 1/8 to about 1/4 inch, preferably about 3/16 inch, and wherein grid bars 28*b*, 28*c*, 28*d* and 28*e* are set at the standard of about 0.05 to about 0.10 inches, preferably about 1/16 inch. The fiber/trash is then further embedded into the saw teeth improving fiber retention and trash removal by subsequent grid bars.

The separated material SMa removed by the first grid bar which contains a very high level of large trash is then discarded, the material from other flow streams SMb–SMd are then passed onto the second saw tooth cleaner for further separation.

The material is processed through grid bars 37*b*, 37*c*, 37*d* and 37*e* in the same way as described for grid bars 28*a*–28*e* in FIGS. 1 and 2, with resulting enhanced trash removal and fiber retention.

Thus, while the present invention has been described herein with reference to particular embodiments thereof, a latitude of modifications, various changes and substitutions are intended in the foregoing disclosure, and it will be appreciated that in some instances some features of the invention will be employed without a corresponding use of other features without departing from the scope and spirit of the invention as set forth. Therefore, many modifications may be made to adapt a particular situation or material to the teachings of the invention without departing from the essential scope and spirit of the present invention. It is intended that the invention not be limited to the particular embodiment disclosed as the best mode contemplated for carrying out this invention, but that the invention will include all embodiments and equivalents falling within the scope of the appended claims.

I claim:

1. An apparatus for separating foreign matter from a fiber containing material comprising:

a) a first and second cylindrical toothed wire cleaning saws effective for releasably capturing fibers thereon, and both of said first and second cleaning saws being in revolving continuous contact with the same cylindrical doffing brush, wherein each of said cylindrical cleaning saws comprise a first grid bar and multiple additional grid bars effective for separating foreign matter from said fiber which is captured on said cleaning saws said second cleaning saw being positioned downstream of said first cleaning saw such that said first grid bar and said additional grid bars of said first saw are effective to generate a first waste stream comprising said foreign matter, wherein the majority, or totality of said first waste stream is directed onto said second cleaning saw which runs the waste stream through a steel roller to compress, embed, and regulate waste streams from the first cleaning saw onto the surface of the second cleaning saw and a second cycle of separation;

b) means for the transfer of the fiber streams captured by the first and second cleaning saws to the doffing brush; and c) said doffing brush adapted to transfer the fiber stream to a lint duct.

2. The apparatus of claim 1 further comprising a trash slide which captures the waste streams generated from the first cleaning saw and delivers it to the second cleaning saw.

3. The apparatus of claim 1 wherein the clearance between the grid bars and the toothed wire of the saw blade ranges from about 0.05 inches to about 0.10 inches.

4. The apparatus of claim 1 wherein the clearance between the first grid bar and the toothed wire of the first saw blade ranges from about 0.25 inches to about 0.50 inches and the clearance of all the rest of the grid bars and the toothed wire of the saw blade ranges from about 0.05 inches to about 0.10 inches.

5. The apparatus of claim 4 wherein the foreign matter ejected from the first grid bar of the first cleaning saw is adapted for transfer out of the apparatus without being further processed.

6. In an apparatus for cleaning fibers comprising a first saw cylinder in combination with doffing brush wherein the improvement comprises a second saw cylinder being positioned with respect to said doffing brush such that said doffing brush can remove captured fiber from both said first and second saw cylinders saws and that the majority or totality of the waste stream from the first saw cylinder is fed through a steel roller to compress, embed, and regulate waste streams from the first cleaning saw onto the surface of the second cleaning saw and reprocessed by the second saw cylinder for additional fiber removal.

* * * * *